US006682136B1

(12) United States Patent
St. Germain

(10) Patent No.: US 6,682,136 B1
(45) Date of Patent: Jan. 27, 2004

(54) COLLAPSIBLE TUBULAR ROCKING CHAIR HAVING OCCUPANT-LAUNCHING MEANS

(76) Inventor: Robert J. St. Germain, 44 Gorman St., Naugatuck, CT (US) 06770

( * ) Notice: Subject to any disclaimer, the term of this patent is extended or adjusted under 35 U.S.C. 154(b) by 0 days.

(21) Appl. No.: 10/200,349

(22) Filed: Jul. 23, 2002

(51) Int. Cl.[7] ..... A47C 4/00
(52) U.S. Cl. ..... 297/18; 297/325; 297/DIG. 10
(58) Field of Search ..... 297/DIG. 10, 325, 297/326, 327, 18; 482/66

(56) References Cited

U.S. PATENT DOCUMENTS 2,675,059 A * 4/1954 Martin ..... 297/18
2,708,962 A * 5/1955 Recheler ..... 297/31
3,112,953 A * 12/1963 Rvaer ..... 297/18
3,154,344 A * 10/1964 Stableford ..... 297/18
3,338,625 A * 8/1967 Shien ..... 297/18
5,346,280 A * 9/1994 Deumite ..... 297/330
5,577,799 A * 11/1996 St. Germain ..... 297/35
5,722,917 A * 3/1998 Olschansky et al. ..... 482/72
5,897,462 A * 4/1999 St. Germain ..... 482/66
6,125,957 A * 10/2000 Kauffmann ..... 180/65.1

* cited by examiner

*Primary Examiner*—Peter M. Cuomo
*Assistant Examiner*—Erika Garrett
(74) *Attorney, Agent, or Firm*—Dallett Hoopes

(57) ABSTRACT

A foldable tubular rocking chair has inverted U-shaped elements secured between its front legs to give stability and to serve as a stop for the crosspiece of the pivoting arm unit when the occupant leans forward during launch. Arms have forward and upward handles to help occupant urge the arm unit down and raise herself to erect condition.

3 Claims, 2 Drawing Sheets

FIG. 1
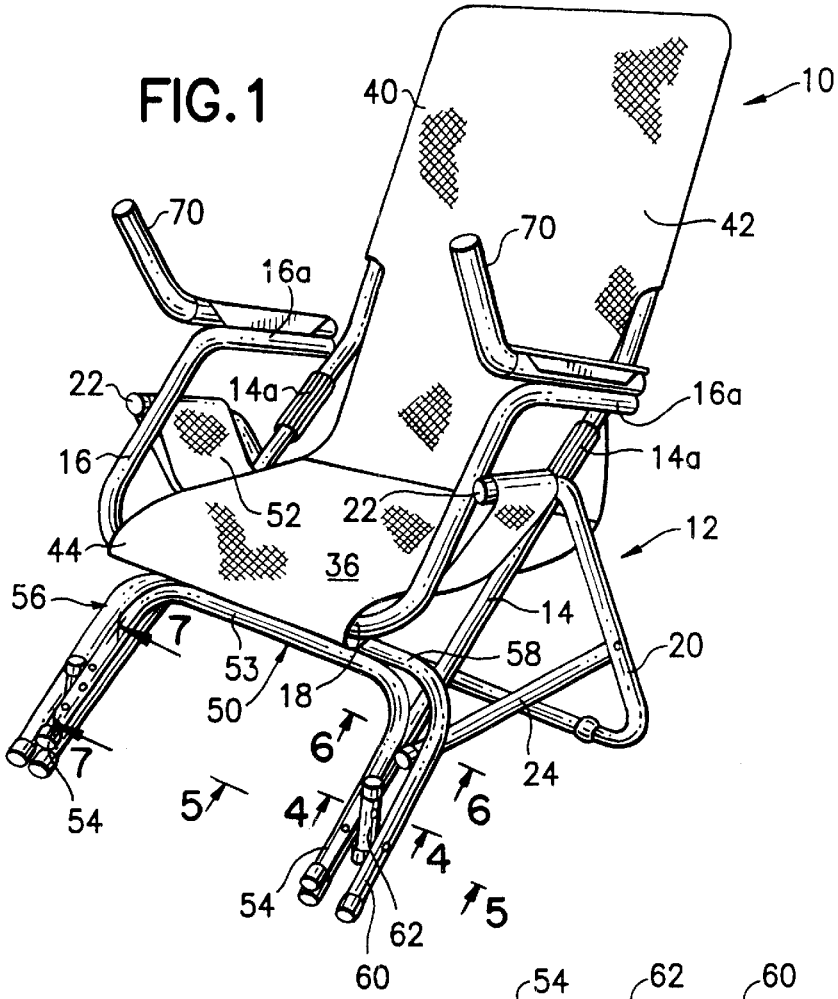
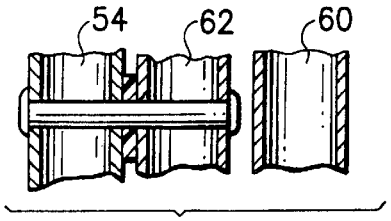
FIG. 4
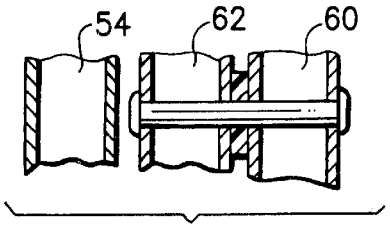
FIG. 5
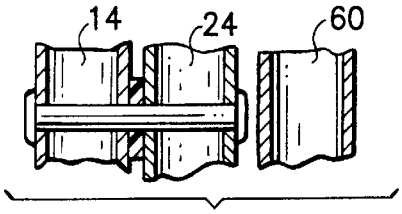
FIG. 6
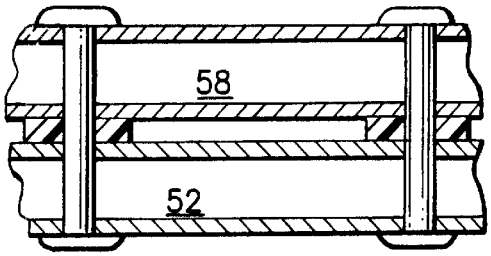
FIG. 7

COLLAPSIBLE TUBULAR ROCKING CHAIR HAVING OCCUPANT-LAUNCHING MEANS

BACKGROUND OF THE INVENTION

This invention relates to a collapsible tubular rocking chair of the type disclosed in my U.S. Pat. No. 5,557,799. More specifically, the invention relates to such a collapsible chair in which an arm unit has gripping handles extending upward from the arms and the arm unit pivots down, driven by the occupant's pushing on the gripping handles during the exit. The arm unit element bottoms out on a stationary frame element to back the arm unit out of the way and effect the "launching" of the occupant from the chair.

The prior art includes a number of patents disclosing tubular-framed chairs wherein the seat and back panel is in the form of a fabric web. Among the chairs disclosed in the prior art having such structure is the rockable chair of deck or lawn type disclosed in the U.S. Pat. No. 2,675,059 to W.C. Martin issued Apr. 13, 1954. Further art is my own aforesaid U.S. Pat. No. 5,557,799 disclosing the collapsible chair and U.S. Pat. No. 5,897,462 disclosing an exercise apparatus.

To the best knowledge of Applicant, no such collapsible chair has been disclosed which helps the patient to "launch" himself, using his own muscle power. The present chair is especially adapted for use by the old and infirm.

SUMMARY OF THE INVENTION

In the present invention there is provided an improvement to a tubular rocking chair frame comprising in an elongate generally open rectangular back unit having parallel long side elements and parallel upper and lower end elements, the long sides being interrupted by selectively foldable aligned hinges. The frame further comprises a generally U-shaped arm unit having a forward bight or crosspiece and rearward legs, the arm unit legs being pivotally attached at their distal ends to the respective long sides of the back unit above the hinges. There is further a generally U-shaped rear unit having a rearward and downward bight and upward legs, the distal ends of the rear unit upward legs being pivotally attached to the respective arm unit legs spaced from the bight of the arm element. The frame also comprises a pair of linear parallel stabilizing elements, one on each side of the frame having opposite ends pivotally connected to a long side element of the back unit adjacent the lower end element and to a rear unit leg spaced from the rear unit bight.

The improvement is such structure as aforesaid wherein the lower end element of the rectangular back unit is a first inverted U-shaped element having a broad bight extending between the parallel side elements, the legs of the U-shaped element being secured to the respective lower ends of the parallel long side elements, and the rearward legs of the arm unit are provided respectively with forward and upward launching handles, the arm unit being pivotable by the occupant so that the forward bight moves down to contact and be stopped by the bight of the inverted U-shaped element.

A second, wider inverted U-shaped element may be provided having a bight longer than the bight of the first inverted U-shaped element, the bights of the inverted U-shaped elements being secured together, the legs of the second U-shaped element adapted to engage the floor outward from the lower ends of the long side elements.

BRIEF DESCRIPTION OF THE DRAWINGS

Further objects and features of the invention will be understood by those skilled in the art from reference to the following specification including the drawings, all disclosing a non-limiting form of the invention. In the drawings:

FIG. 1 is a perspective view of a chair embodying the invention;

FIG. 4 is an enlarged fragmentary sectional view taken on the line 4—4 of FIG. 1;

FIG. 5 is an enlarged fragmentary sectional side view taken on the line 5—5 of FIG. 1;

FIG. 6 is an enlarged sectional view taken on the line 6—6 of FIG. 1;

FIG. 7 is an enlarged fragmentary sectional view taken on the line 7—7 of FIG. 1.

DESCRIPTION OF THE PREFERRED EMBODIMENT

A chair embodying the improvement is generally designated 10 in FIG. 1. It comprises a tubular frame 12 including a single generally rectangular tubular back unit 14. Unit 14 serves as both the back support at its upper end and the forward legs at its forward lower end.

Each of the elongate tubular sides of unit 14 can be in two sections, divided intermediate the ends, hinged together and can be selectively held in their continuous linear condition by a sliding sleeve 14*a* closely circumposing the adjacent ends of the two sections and the hinge and held there by spring detents or the like, all as thoroughly disclosed in my U.S. Pat. No. 5,577,799. Alternatively, the sleeve can be slid longitudinally of the tubular side to permit the two sections to be folded at the hinge for greater compactness in traveling or storage.

Figure 8:
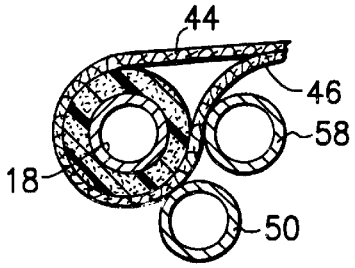
FIG. 8 is an enlarged fragmentary sectional view showing the bight of the arm unit contacting the bight of the inverted U-shaped elements in launching.
Figure 3:
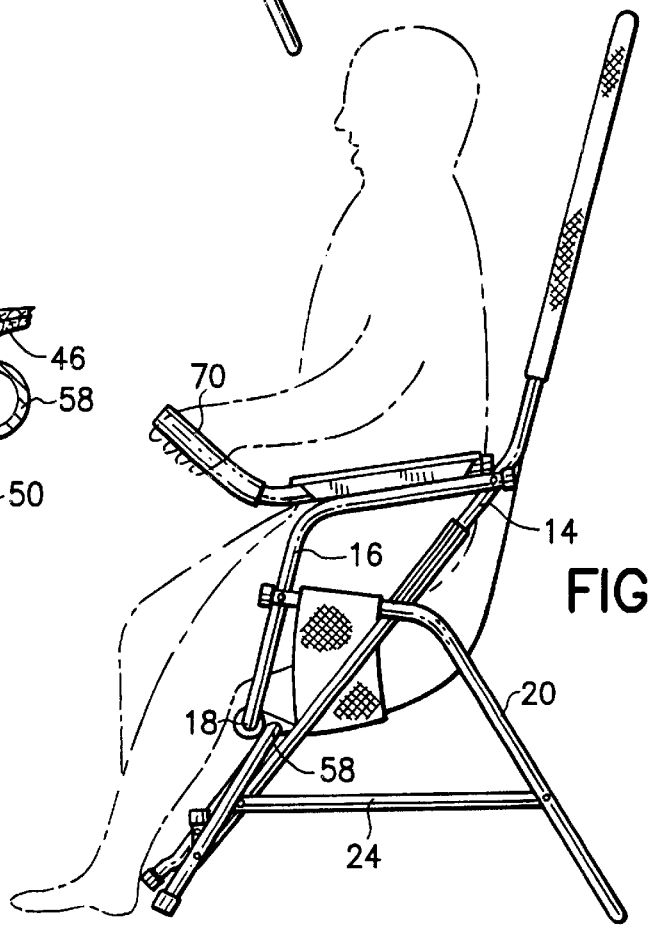
FIG. 3 is similar to FIG. 2 but showing the chair in launch position.

An arm unit 16 which is U-shaped and bent downward at a forward location and comprises legs 16*a* which serve as the arms of the chair and a bight which is in the form of the forward crosspiece 18. The crosspiece 18 may, for comfort, be padded by a sponge sleeve (FIG. 8). At their rearward ends the legs 16*a* are pivotally attached respectively to the side elements of the back unit 14. A U-shaped rear unit 20 comprises leg elements attached to the arm unit. The rear unit includes side portions 22 disposed at a level above the crosspiece 18 for support of the seat-reinforcing web as will be explained. To permit rocking, the rear unit and back unit are not attached.

Separate stabilizing elements 24 are pivotally secured to the rear unit legs and back unit side elements to keep those parts appropriately spaced during the rocking motion and when the chair is still.

The chair further comprises a fabric strip or sling 36 as disclosed in my U.S. Pat. No. 5,476,308. The upper rearward portion of the sling 36 has a coextensive back panel (not shown) secured thereto at its top and sides to define a pocket 40 which receives the top of the tubular back unit 14. The sling extends downward to constitute a back-supporting portion 42 and a seat-supporting portion 44. The forward lower end of the sling loops around the forward crosspiece 18 and is doubled back under the seat-supporting portion 44 in a tail 46 (FIG. 8). A transverse elongate seat-reinforcing web 52 of fabric is provided separate from or integral with the sling 36. It encircles (FIG. 1) the upper portion 22 of the legs of the rear unit 20 and its opposite ends may be secured together. The arrangement of the tail portion and the seat-reinforcing web 52 can be adjustable as in my U.S. Pat. No. 5,476,308 or not, as desired.

The improvement to the chair will now be discussed. Straddling to the lower ends of the side elements 14 is an inverted U-shaped element 50. The element is characterized by a bight 53 and a pair of legs 54 which may each be capped at their lower ends and are secured by rivets or other fasteners to the lower ends of the side elements 14.

A second, wider, inverted U-shaped element 56 includes the bight 58 and the floor engaging legs 60 which may also be capped. The bight 58 is secured to the bight 50 by rivets so that the result is a nesting pair of inverted U-shaped elements, the wider of the two U-shaped elements may be referred to as the stabilizing wings because they engage the floor outward of the perimeter of the chair and afford substantial lateral stability to the chair.

Intermediate the legs 60 and the legs 54 of the inner and wider U-shaped elements are disposed generally vertical short tubular struts 62. These serve not only to space the legs 60, 54 from each other, but provide a shock-absorbing function between the inner legs 54 and the outer legs 60. The struts are each short tubes 62 (FIGS. 4 and 5) having capped ends. The tubes are generally parallel and between the legs 60, 54. One end of each tube is secured by rivet to the adjacent leg 60 of the outer inverted U-shaped element 56. The other end of each tube is secured by rivet to the adjacent leg 54 of the inner inverted U-shaped element. Functionally, should the lower end of one of the adjacent legs 54, 60 engage the floor and not the other 60, 54, the strut will distribute the load to the other leg as the adjacent parts of the U-shaped elements 50, 46, flex so that both of the legs wind up bearing some of the load.

Figure 2:
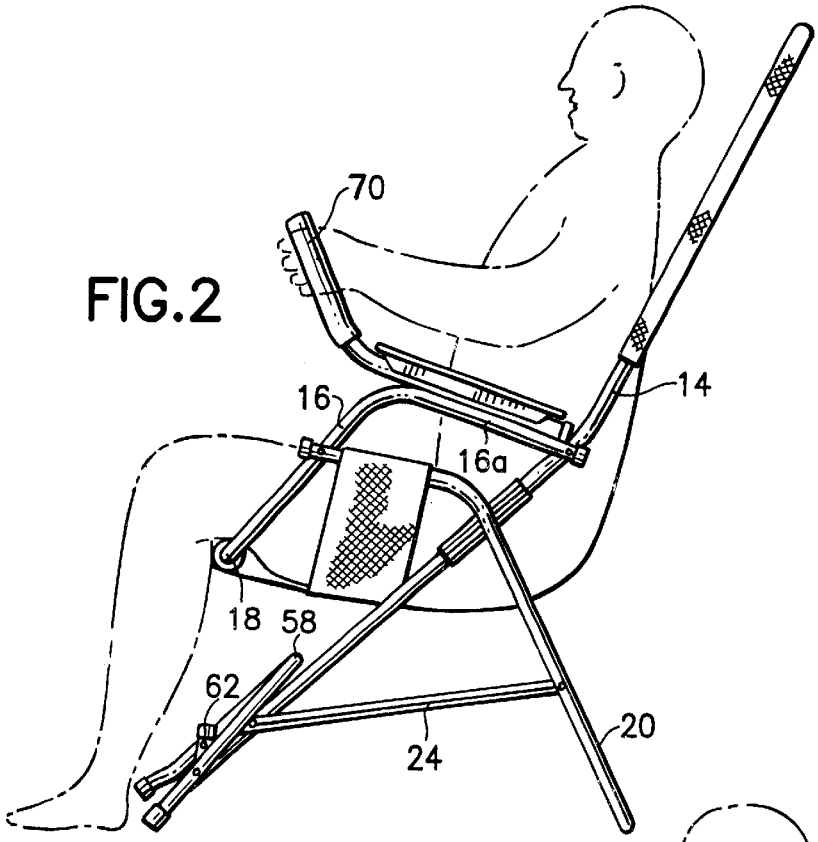
FIG. 2 is a side view of the chair showing an occupant in broken lines.

Referring now to the arm unit 16, the upper generally horizontal run 16*a* (FIG. 2) have secured therealong the anchoring run of gripping handles 70. These handles, also tubular, may be bent with respect to the anchoring run at an angle of from 30–50° depending on the preference of the occupant. These handles are used as the occupant prepares to launch himself by pushing downward.

In the use of the chair, the occupant may be seated on a wedge-shaped cushion (not shown) riding on the portion 44 of the sling. In the launching process, the occupant grasps the gripping handles 70 and pulls her body forward. She then pushes the handles forward and down. This causes the arm unit 16 to swing downward about its pivots at back unit 14 and the cross-piece 18 eventually contacts one or both of the bights 58 and/or 50 of the two U-shaped elements.

The engagement of the padded crosspiece with bights 50, 58 gives a firm bottoming to the downward swing of the arm unit and this, coupled with the outward span of the wings, i.e., legs 60, of the larger U-shaped element, gives an absolutely rock-like security to the forward and upward support of the occupant. The occupant can now, using the gripping handles, raise her trunk off the chair so that she is in virtual erect condition.

In this operation the occupant has used her own muscle power to arrive at virtually an erect walking position. After she leaves the chair, the chair arm unit pivots back to its original position and the chair, because of its configuration, restores itself to FIG. 1 shape.

For mobility, the chair may be readily folded on as discussed in my earlier U.S. Pat. No. 5,577,799, using the hinges (not shown) and sliding sleeves 14*a* as described in that patent. Thus, when it is desired to fold the chair frame, it is only necessary to move the sleeve 14*a* downward, clearing the hinges for pivot. Because the back unit 14 is articulated at about the midpoint, as described in U.S. Pat. No. 5,577,799, the chair in folded condition is only roughly half the length of the back unit. Thus folded, the frame is readily moved and stored. It will be understood that to effect an interference-free folding, some of the elements may have to be dog-legged or otherwise bent from linear condition.

The fabric of the sling and the support 52 is similar to that arrangement disclosed in my earlier U.S. Pat. No. 5,476,308, with modifications (such as the sling and transverse piece being integral), to better accommodate the weight and configuration of the occupant.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. In a tubular rocking chair, a frame comprising an elongate generally open rectangular back unit having parallel long side elements and an upper end element, the long sides being interrupted by selectively foldable aligned hinges, the frame further comprising a generally U-shaped arm unit having a forward crosspiece bight and rearward legs, the arm unit legs being pivotally attached at their distal ends to the respective long sides of the back unit above the hinges, a generally U-shaped rear unit having a downward bight and upward legs, the distal ends of the rear unit upward legs being pivotally attached to the respective arm unit legs at points spaced from the crosspiece bight of the arm unit, and a pair of linear parallel stabilizing elements, one on each side of the frame having opposite ends pivotally connected to a long side element of the back unit adjacent its lower end and to the respective rear unit legs at points spaced from the rear unit bight, the improvement including an inner inverted U-shaped element having legs and a bight, the legs of the inverted U-shaped element being parallel to and secured against the respective lower ends of the parallel long side elements, and the rearward legs of the arm unit being provided respectively with forward and upward launching handles, the arm unit being pivotable by the occupant by means of the handles so that the forward crosspiece bight moves down to contact and be stopped by the bight of the inverted U-shaped element.

2. A tubular rocking chair as claimed in claim 1 wherein a second wider outer inverted U-shaped element is provided having a bight longer than the bight of the inner inverted U-shaped element, the bights of the inverted U-shaped elements being secured together, the legs of the outer U-shaped element adapted to engage the floor outward from the lower ends of the long side elements, and a pair of struts, each having one end connected to an adjacent leg of the outer inverted U-shaped element and the other end connected to an adjacent lea of the inner inverted U-shaped element.

3. A tubular rocking chair frame including:

(a) spaced generally parallel side elements terminating downwardly in front legs, having (b) an inverted U-shaped element having a bight and legs secured parallel to and against the respective front legs, and ©) a tubular U-shaped arm unit having forward arm portions on each side, downward leg portions down from the arm portions and a crosspiece connecting the leg portions, the arm unit having upwardly inclined gripping handles extending therefrom, the arm portions having mutually aligned pivotal attachments to the side elements, the attachments being spaced above the inverted U-shaped element, the arm unit being pivotable by an occupant downward about the pivotal attachment to a position at which the crosspiece bottoms out against the bight of the inverted U-shaped element.

* * * * *